US011335359B2

(12) United States Patent
Ahlberg et al.

(10) Patent No.: US 11,335,359 B2
(45) Date of Patent: May 17, 2022

(54) METHODS AND DEVICES FOR OBTAINING AN EVENT DESIGNATION BASED ON AUDIO DATA

(71) Applicant: MINUT AB, Malmo (SE)

(72) Inventors: Fredrik Ahlberg, Lund (SE); Nils Mattisson, Malmo (SE); Panagiotis Papaioannou, Malmo (SE)

(73) Assignee: MINUT AB, Malmo (SE)

( * ) Notice: Subject to any disclaimer, the term of this patent is extended or adjusted under 35 U.S.C. 154(b) by 16 days.

(21) Appl. No.: 16/621,612

(22) PCT Filed: Jun. 13, 2018

(86) PCT No.: PCT/SE2018/050616

§ 371 (c)(1),
(2) Date: Dec. 11, 2019

(87) PCT Pub. No.: WO2018/231133

PCT Pub. Date: Dec. 20, 2018

(65) Prior Publication Data

US 2020/0143823 A1 May 7, 2020

(30) Foreign Application Priority Data

Jun. 13, 2017 (SE) ..... 1750746-8

(51) Int. Cl.
*G10L 25/51* (2013.01)
*G10L 25/18* (2013.01)
*G10L 25/27* (2013.01)

(52) U.S. Cl.
CPC ..... *G10L 25/51* (2013.01); *G10L 25/18* (2013.01); *G10L 25/27* (2013.01)

(58) Field of Classification Search
USPC ..... 381/26, 55, 56, 58, 110
See application file for complete search history.

(56) References Cited

U.S. PATENT DOCUMENTS 8,917,186 B1 12/2014 Grant
2006/0273895 A1 12/2006 Kollin
(Continued)

FOREIGN PATENT DOCUMENTS

CA 2432751 12/2004
WO WO2006052023 5/2006
(Continued)

OTHER PUBLICATIONS

International Search Report on corresponding PCT application (PCT/SE2018/050616) from International Searching Authority (SE) dated Sep. 14, 2018.
(Continued)

*Primary Examiner* — Yosef K Laekemariam
(74) *Attorney, Agent, or Firm* — Klein, O'Neill & Singh, LLP

(57) ABSTRACT

A method performed by a processing node (10), comprising the steps of: i. obtaining (11), from at least one communication device (100), audio data (12) associated with a sound and storing (13) the audio data (12) in the processing node (10), ii. Obtaining (15) an event designation (16) associated with the sound and storing (17) the event designation (16) in the processing node (10), iii. determining (19) a model (20) which associates the audio data (12) with the event designation (16) and storing the model (21), and iv. Providing (23) the model (20) to the communication device (100). A method performed by the communication device (100), as well as a processing node (10), a communication device (100), a system (1000) and computer programs for performing the methods are also described.

14 Claims, 9 Drawing Sheets

(56) References Cited

U.S. PATENT DOCUMENTS

Figure 1:
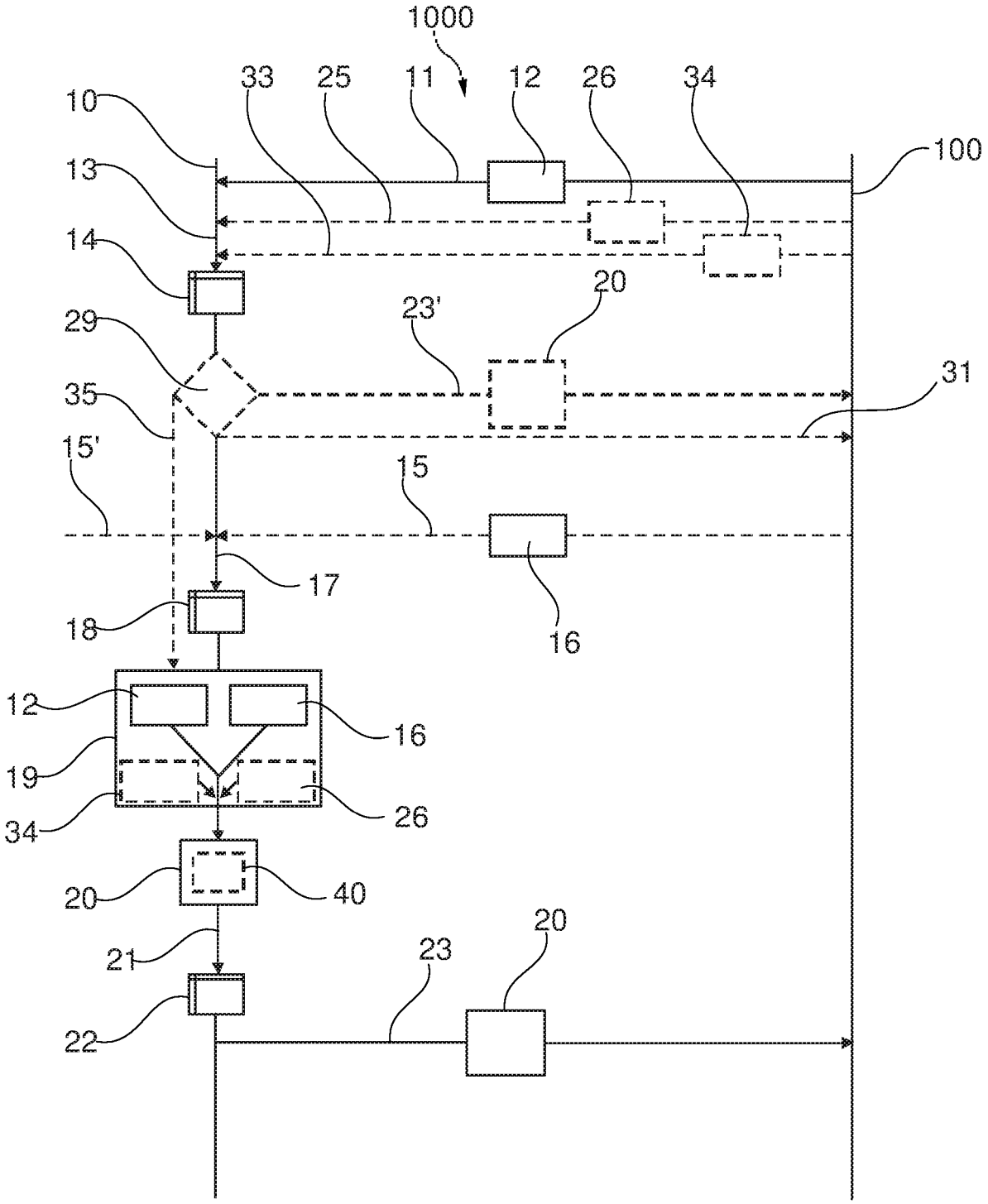

| | | | |
|---|---|---|---|
| 2007/0043459 | A1 | 2/2007 | Abbott, III et al. |
| 2008/0162133 | A1 | 7/2008 | Couper et al. |
| 2008/0240458 | A1 | 10/2008 | Goldstein et al. |
| 2009/0309728 | A1 | 12/2009 | Yamamura |
| 2012/0224706 | A1 | 9/2012 | Hwang et al. |
| 2013/0077797 | A1 | 3/2013 | Hoy et al. |
| 2015/0066497 | A1 | 3/2015 | Sun et al. |
| 2015/0112678 | A1 | 4/2015 | Binks et al. |
| 2016/0117905 | A1 | 4/2016 | Powley |
| 2016/0150338 | A1 | 5/2016 | Kim et al. |
| 2016/0314782 | A1 | 10/2016 | Klimanis |
| 2016/0330557 | A1 | 11/2016 | Christian et al. |
| 2016/0364963 | A1* | 12/2016 | Matsuoka ..... G10L 25/51 |
| 2017/0004684 | A1 | 1/2017 | Slater |

FOREIGN PATENT DOCUMENTS

| | | |
|---|---|---|
| WO | WO2012162799 | 12/2012 |
| WO | WO2015181722 | 12/2015 |

OTHER PUBLICATIONS

Written Opinion on corresponding PCT application (PCT/SE2018/050616) from International Searching Authority (SE) dated Sep. 14, 2018.

* cited by examiner

METHODS AND DEVICES FOR OBTAINING AN EVENT DESIGNATION BASED ON AUDIO DATA

CROSS-REFERENCE TO RELATED APPLICATION

This application is the National Phase, under 35 U.S.C. § 371(c), of International Application No. PCT/SE2018/050616, filed Jun. 13, 2018, which claims priority from Swedish Application No. SE 1750746-8, filed Jun. 13, 2017. The disclosures of all of the referenced applications are incorporated herein by reference in their entirety.

FEDERALLY SPONSORED RESEARCH OR DEVELOPMENT

Not Applicable

FIELD OF THE INVENTION

The present invention relates to the field of methods and devices for obtaining an event designation based on audio data, such as for obtaining an indication that an event has occurred based on sound associated with the event. Such technology may for example be used in so-called smart home devices. The method and devices may comprise one or more communication devices placed in a home or other milieu in connection with a processing node for obtaining audio data related to an event occurring in the vicinity of the communication device for obtaining an event designation, i.e. information identifying the event, based on audio data associated with the sound that the communication device records when the event occurs.

BACKGROUND OF THE INVENTION

Today different types of smart home devices are known. These devices includes network-capable video cameras able to record and/or stream video and audio from one location, such as the interior of a home or similar, via network services (internet) to a user for viewing on a handheld device such as a mobile phone.

As regards video, image analysis can be used to provide an event designation and direct a user's attention to the fact that the event is occurring or has occurred. Other sensors such as magnetic contacts and vibration sensors are also used for the purpose of providing event designations.

Sound is an attractive manifestation of an event to consider as it typically requires less bandwidth than detecting events using video. Thus devices are known which obtain audio data by recording and storing sounds, and which use predetermined algorithms to attempt to recognize or classify the audio data as being associated with a specific event, and therefrom obtain and output information designating the event.

These devices include so called baby monitors which provide communication between a first "baby" unit device placed in the proximity of a baby and a second "parent" unit device carried by the baby's parent(s) so that the activities of the baby may be monitored and the status, sleeping/awake, of the baby can be determined remotely.

Devices of this type typically benefit from an ability to provide an event designation, i.e. to inform the user when a specific event is occurring or has occurred, as this does away with the need for constant monitoring. In the case of baby monitors this includes the configuration of the first device to provide a specific event designation, such as the information "baby crying", when audio data consistent with the sounds of a baby crying is recorded by the first device. This event designation may be used to trigger one or both of the first and second units so that the second unit receives and outputs the sound of the baby crying, but otherwise is silent.

Thus the first unit may continuously record audio data and compare it to audio data representative of a certain event, such as the crying baby, and alert the user if the recorded audio data matches the representative audio data. Event designations which may be similarly associated with events and audio data include the firing of a gun, the sound of broken glass, the sounding of an alarm, the barking of a dog, the ringing of a doorbell, screaming, and coughing.

With a wide number of events that would be convenient and useful if they could be recognized and event designations obtained for further action by persons or systems, there is a high demand for methods and systems capable of providing event designations associated with audio data for further events, with higher accuracy, in more diverse backgrounds and milieus, and where the audio data is associated with the sound of multiple events occurring at the same time.

Especially the ability to obtain further event designations for further events using recognition of sounds is important to obtain further benefits from this type of technology. These further events and sounds could for example include doors opening and closing, sounds indicative of the presence of a human or animal in a building or milieu, traffic, the sounds of specific dogs, cats and other pets, etc. However as these types of events are not associated with as distinctive sounds such as gunshots, screams, and broken glass, and as the sounds related to these events may be very specific to each user of this technology, it is difficult to obtain representative audio data for these events, and thus difficult to obtain event designations for these events.

Accordingly, objects of the present invention include the provision of methods and devices capable of providing event designations for further sounds of further events.

Further objects of the present invention include the provision of methods and devices capable of providing event designations which more accurately determines that an event has occurred.

Still further objects of the present invention include the provision of methods and devices capable of providing event designations to multiple simultaneously occurring events in different backgrounds and/or milieus.

SUMMARY OF THE INVENTION

At least one of the above mentioned objects are, according to the first aspect of the present invention achieved by a method performed by a processing node, comprising the steps of:

i. obtaining, from at least one communication device, audio data associated with a sound and storing the audio data in the processing node,
ii. obtaining an event designation associated with audio data and storing the event designation in the processing node,
iii. determining a model which associates the audio data with the event designation and storing the model, and
iv. providing the model to the communication device.

By determining the models in a processing node, to which a communication device may provide any audio data associated with any sound that the communication device can record, event designations may then, in the communication device, be obtained based on the model for potentially all events and associated sound that may be of interest for a user of the communication device. Thus the user of the communication device may for example wish to obtain an event designation for the event that the front door closes. The user is now not limited to generic sounds such as the sound of gunshots, sirens, glass breaking, instead the user can now record the sound of the door closing, whereafter audio data associated with this sound and the associated event designation "door closing" is provided to the processing node for determining a model which is then provided to the communication device.

In addition the model is determined in the processing node thus doing away with the need for computing intensive operations in the communication device.

The processing node may be realised on one or more physical or virtual servers, including at least one physical or virtual processor, in a network, such as a cloud network. The processing node may also be called a backend service.

The communication device may be a smart home device such as a fire detector, a network camera, a network sensor, a mobile phone. The communication device is preferably battery-powered and includes a processor, memory, and circuitry and antenna for wireless communication with the processing node via a network such as for example the internet.

The audio data may be a digital representation of an analogue audio signal of a sound. The audio data may further be transformed into frequency domain audio data. The audio data may also comprise both a time-domain representation of a sound signal and a frequency domain transform of the sound signal. Further, audio data may comprise on or more features of the sound signal, such as MFCC (Mel-frequency cepstrum coefficients, their first and second order derivatives, the spectral centroid, the spectral bandwidth, RMS energy, time-domain zero crossing rate, etc.

Accordingly audio data is to be understood as encompassing a wide range of data associated with a sound and an analog audio signal of the sound, from a complete digital representation of the audio signal to one or more features extracted or computed from the audio signal.

The audio data may be obtained from the communication device via a network such as a local area network, a wide area network, a mobile network, the internet, etc.

The sound may be recorded by a microphone provided in the communication device. The sound may be any sound that is the result of an event occurring. The sound may for example be the sound of a door closing, the sound of a car starting, etc.

In addition the sound may be an echo caused by the communication device emitting a sound acting as a "ping" or short sound pulse, the echo thereof being the sound for which the audio data is obtained. Thus the event need not be an event occurring outside the control of the processing node and/or communication device, rather the event and event designation, such as a room being empty of people, may be triggered by an action of the processing node and/or the communication device.

The sound, and hence the audio data may refer to audio of a wide range of frequencies including infrasound, i.e. a frequency lower than 20 Hz, as well as ultrasound, i.e. a frequency above 20 kHz.

Accordingly the audio data may be associated with sounds in a wide spectrum, from below 20 Hz to above 20 kHz.

In the context of the present invention the term "event designation" is to be understood as information describing or classifying an event. An event designation may be a plaintext text string, a numeric or alphabetic code, a set of coordinates in a one- or multidimensional classification structure, etc.

It is further to be understood that an event designation does not guarantee that the corresponding event has in fact occurred, the event designation however provides a certain probability that the event associated with the sound yielding the audio data on which the model for obtaining the event designation is built, has occurred.

The event designation may be obtained from the communication device, from a user of the communication device, via a separate interface to the processing node, etc.

The model comprises one or more algorithms or lookup tables which based on input in the form of the audio data, provides an event designation. In a simple example the model uses principal component analysis on audio data comprising a vector of features extracted from audio signal to position different audio data from different sounds/events into separate areas in for example a two dimensional surface determined by the two first principal components, and associating each area with an event designation. In the communication device audio data obtained from a specific recorded sound can then be subjected to the model, and the position in the two-dimensional surface for this audio data determined. If the position is within one of the areas which are associated with a specific event designation, then this event designation is outputted and the user may receive this event designation, informing him that the event associated with the event designation has, with a higher or lower degree of certainty, occurred.

The model may be determined by training in which audio data associated with sounds of known events, i.e. where the user of the communication device knows which event has occurred, for example by specifically operating the communication device to record a sound as the user performs the event or causes the event to occur. This may for example be that the user closes the door to obtain the sound associated with the event that the door closes. The more times the user causes the event to occur, the more audio data may be obtained to include in the model to better map out the area, in the example above in the two dimensional surface where audio data of the sound of a door closing is positioned. Any audio data obtained by the processing node may be subjected to the models stored in the processing node. If an event designation can be obtained from one of the models with a sufficiently high certainty of the event designation being correctly associated with the audio data, then the audio data may be included in that model. Adding audio data to a model can be used to be able to better compute the probability that a certain audio data is associated with an event designation. Using the above-mentioned simple two-dimensional example a number of positions in the two dimensional surface, from audio data associated with the same event designation but slightly different, can be used to compute confidence intervals for the extension or boundary of the area associated with the event designation, thus allowing the certainty that further audio data to be subjected to the model correctly yields the event designation to be computed, for example by comparing the position of this further audio data to the positions of audio data already included in the model.

Thus the model associates the audio data with the event designation.

The processing node may further determine combined models, which are models based on a Boolean combination of event designations of individual models. Thus a combined models may be defined that associates the event designations "front door opening" from a first model and "dog barking"

from a second model with a combined event designation "someone entering the house". Furthermore, a combined model may also be defined based on one or more event designation from models combined with other data or rules such as time of day, number of times audio data has been subjected to the one or more models. Thus a combined model may comprise the event designation "flushing a toilet" with a counter, which counter may also be seen as a simple model or algorithm, and associate the event designation "toilet paper is running out" with the event designation "flushing a toilet" having been obtained from the model X times, X for example being 30.

The model may be provided to the communication device via any of the networks mentioned above for obtaining the audio data from the communication device.

In the preferred embodiment of the method according to the first aspect of the present invention:

step (i) comprises obtaining, from a first plurality of communication devices, a second plurality of audio data associated with a second plurality of sounds, and storing the second plurality of audio data in the processing node, step (ii) comprises obtaining a second plurality of event designations associated with the second plurality of audio data and storing the second plurality of event designations in the processing node, step (iii) comprises determining a second plurality of models, each model associating one of the second plurality of audio data with one of the second plurality of event designations and storing the second plurality of models, and step (iv) comprises providing the second plurality of models to the first plurality of communication devices.

By having a first plurality of communication devices providing the second plurality of audio data to the processing node each user of a communication device may obtain models for obtaining event designations of events which have not yet occurred for that user. Thus each communications device may provide event designations of a much wider scope of different events.

Suppose for example that user A having a communication device A records the sound of a truck idling outside his house. This sound, and the associated audio data together with the event designation "truck idling" is then provided to the processing node by communication device A under the instruction of user A. Now communication device B of user B, who lives remotely, may obtain the model associated with the sound and event designation provided by user A. This allows the user B to obtain the event designation that a truck is idling outside his house if that event should occur, without requiring user B to record such a sound himself.

The first plurality and second plurality may be equal or different.

The second plurality of models may be provided to the first plurality of communication devices in various ways.

In one alternative embodiment of the method according to the first aspect of the present invention the each communication device is associated with a unique communication device ID, and the method further comprises the steps of:

v. obtaining the communication device ID from each communication device, vi. associating the communication device ID from each communication device with the audio data obtained from that communication device, and wherein:

step (iii) comprises associating each model with the communication device ID of the communication device from which the audio data used to determine the model was obtained, and step (iv) comprises providing the second plurality of models to the first plurality of communication devices so that each communication device obtains at least the models associated with the communication device ID associated with that communication device.

This alternative embodiment ensures that each communication device is provided with at least the models associated with hat communication device. This is advantageous where storage space in the communication devices is limited thus forbidding the storing of all the models on each device.

The communication device ID may be any type of unique number, code, or sequence of symbols or digits/letters.

In the case that only the models associated with a communication device is provided to that communication device, the preferred embodiment of the method according to the first aspect of the present invention further comprises the steps of:

vii. obtaining, from a first one of the first plurality of communication devices, a first audio data not associated with any model provided to that communication device, viii. searching, among the audio data obtained from the first plurality of communication devices in step (i), for a second audio data which is similar to the first audio data, and which was obtained by a second one of the first plurality of communication devices, and, if the second audio data is found:

ix. providing, to the first one of the first plurality of communication devices, the model associated with the second audio data, or, if the second audio data is not found:

x. prompting the first one of the first plurality of communication devices to provide the processing node with a first event designation associated with the first audio data, xi. determining a first model which associates the first audio data with the first event designation and storing the first model, and xii. providing the first model to the first one of the plurality of communication devices.

By this embodiment models are provided to the communication devices only as needed. This allows obtaining event designations on a wide range of events, without needing to provide all models to all communication devices. Further, in case the second audio data is not found, then by prompting the first one of the first plurality of communication devices for this information the number of models in the processing node can be increased. Searching, among the audio data obtained from the first plurality of communication devices in step (i), for a second audio data which is similar to the first audio data, may encompass or comprise subjecting the first audio data to the models stored in the processing node to determine if any model provides an event designation with a calculated accuracy better than a set limit.

In an alternative embodiment of the method according to the first aspect of the present invention:

step (iv) comprises providing all of the second plurality of models to each of the first plurality of communication devices.

This may be advantageous where storage capacity in the communication devices is larger than the needed to store all the models as it decreases the need for communication between the communication devices and the processing node.

In a preferred embodiment of the method according to the first aspect of the present invention the method further comprises the step of:

xiii. obtaining, from each communication device, non-audio data associated with the sound and storing the non-audio data in the processing node, and wherein step (iii) comprises determining a model which associates the audio data and the non-audio data with the event designation.

This is advantageous as it may increase the accuracy of the event designation properly designating the event that has occurred.

In preferred embodiments of the method according to the first aspect of the present invention the non-audio data comprises one or more of barometric pressure data, acceleration data, infrared sensor data, visible light sensor data, Doppler radar data, radio transmissions data, air particle data, temperature data and localisation data of the sound.

Thus barometric pressure data, associated with a variation in the barometric pressure in a room, may be associated with the sound and event of a door closing, and used to determine a model which more accurately provides the event designation that a door has been closed.

Further temperature data may be associated with the sound of a crackling fire to more accurately provide the event designation that something is on fire.

Although audio data is a rich source of information regarding an event occurring, it is contemplated within the context of the present invention that the methods according to the first and second aspects of the present invention may be performed using non-audio data only.

Further, as models may be constructed using different algorithms, in preferred embodiments of the method according to the first aspect of the present invention:

each model determined in step (iii) comprises a third plurality of sub-models, each sub-model being determined using a different processing or algorithm associating the audio data, and optionally also the non-audio data, with the event designation.

The event designations for different sub-models may be evaluated for accuracy, or weighted and combined to increase accuracy.

In preferred embodiments of the method according to the first aspect of the present invention each model and/or sub-model is based at least partly on principal component analysis of characteristics of frequency domain transformed audio data and optionally also non-audio data, and/or at least partly on histogram data of frequency domain transformed audio data and optionally also non-audio data.

In preferred embodiments of the method according to the first aspect of the present invention the method further comprises the steps of:

xiv. obtaining, from at least one communication device, third audio data and/or non-audio data associated with a sound and storing the third audio data and/or non-audio data in the processing node, xv. searching, among the audio and/or non-audio data stored in the processing node, for a fourth audio data and/or non-audio data which is similar to the third audio data and/or non-audio data, and if the fourth audio and/or non-audio data is found:

xvi. re-determining the model, associated with the fourth audio data and/or non-audio data, by associating the event designation associated with the fourth audio and/or non-audio data with both the third audio data and/or non-audio data and the fourth audio data and/or non-audio data.

This is advantageous as it refines the model and provides for better estimations of the accuracy or probability that a certain event designation is correct.

Multiple audio data may be used to re-determine the model.

At least one of the above-mentioned objects is further obtained by a method performed by a communication device on which a first model associating first audio data with a first event designation is stored, comprising the steps of:

xvii. recording an audio signal of a sound, generating audio data associated with the sound based on the audio signal, and storing the audio data, xviii. subjecting the audio data to the first model stored on the communication device in order to obtain the first event designation associated with the first audio data, xix. if the first event designation is not obtained in step (xviii), performing the steps of:

b. providing the audio data to a processing node, c. obtaining and storing, from the processing node, a second model associating the audio data with an second event designation associated with a second audio date d. subjecting the audio data to the second model stored on the communication device in order to obtain the second event designation associated with the second audio data, and e. providing the second event designation to a user of the communication device.

The descriptions of steps and features mentioned in the method according to the first aspect of the present invention apply also to the steps and features of the method according to the second aspect of the present invention.

The audio data may be subjected to the first or second model so that the model yields the event designation.

The event designation may be provided to the user via the internet, for example as an email to the user's mobile phone. The user is preferably a human.

Thus in a preferred embodiment of the method according to the second aspect of the present invention the first and second models further associate first and second non-audio data with the first and second event designation, respectively step (xvii) further comprises obtaining non-audio data associated with the sound and storing the non-audio data, step (xviii) further comprises subjecting the non-audio data together with the audio data to the first model, step (xix)(b) further comprises providing the non-audio data to the processing node, and, step (d) further comprises subjecting the non-audio data to the second model.

As discussed above non-audio data is advantageous as it may increase the accuracy of the model in providing the event designation based on audio data and non-audio data.

Further, in a preferred embodiment of the method according to the second aspect of the present invention the non-audio data is obtained by a sensor in the communication device and comprises one or more of barometric pressure data, acceleration data, infrared sensor data, visible light sensor data, Doppler radar data, radio transmissions data, air particle data, temperature data and localisation data of the sound.

The communication device may comprise various sensors to provide the non-audio data.

In order to continuously increase the number of models in the processing node, in one embodiment of the method according to the second aspect of the present invention:

step (xvii) comprises the steps of:

f. continuously measuring the energy in the audio signal, g. recording and generating the audio data once the energy in the audio signal exceeds a threshold, h. providing the audio data thus generated to the processing node, and the method further comprises the steps of:

xx. receiving, from the processing node, a prompt for an event designation associated with the audio data provided to the processing node, xxi. obtaining an event designation from the user of the communication device, xxii. providing the event designation to the processing node, xxiii. obtaining, from the processing node, a model associating the audio data with the event designation obtained from the user.

This is advantageous as it allows each communication device to assist in increasing the number of models in the processing node.

The communication device may thus continuously obtain an audio signal and measure the energy in the audio signal.

The threshold may be set based on the time of day and/or raised or lowered based on non-audio data.

The prompt from the processing node may be forwarded by the communication device to a further device, such as a mobile phone, held by the user of the communication device.

Further, in one embodiment of the method according to the second aspect of the present invention each model obtained and/or stored by the communication device comprises a plurality of sub-models, each sub-model being determined using a different processing or algorithm associating the audio data, and optionally also the non-audio data, with the event designation, and wherein:

step (xviii) comprises the steps of:

i. obtaining a plurality of event designations from the plurality of submodels, j. determining the probability that each of the plurality event designations corresponds to an event associated with the audio data, k. selecting, among the plurality of event designations, the event designation having the highest probability determined in step (j), and providing that event designation to the user of the communication device.

This is advantageous in that provides for increased range of detection of events.

Further, in one embodiment of the method according to the second aspect of the present invention each model and/or sub-model is based at least partly on principal component analysis of characteristics of frequency domain transformed audio data and optionally also non-audio data, and/or at least partly on histogram data of frequency domain transformed audio data and optionally also non audio data.

At least one of the above-mentioned objects is further obtained by a third aspect of the present invention relating to a processing node configured to perform the method according to the first aspect of the present invention At least one of the above-mentioned objects is further obtained by a fourth aspect of the present invention relating to a communication device configured to perform the method according to the second aspect of the present invention.

At least one of the above-mentioned objects is further obtained by a fifth aspect of the present invention relating to a system comprising a processing node according to the third aspect of the present invention and at least one communication device according to the fourth aspect of the present invention.

Additional sixth and seventh aspects of the present invention relate to a computer program comprising instructions which, when executed on at least one processing node, causes the processing node to carry out the method according the first aspect of the present invention, and a computer program comprising instructions which, when executed on at least one processor in a communication device, causes the communication device to carry out the method according to the second aspect of the present invention.

BRIEF DESCRIPTION OF THE FIGURES AND DETAILED DESCRIPTION

Figure 2:
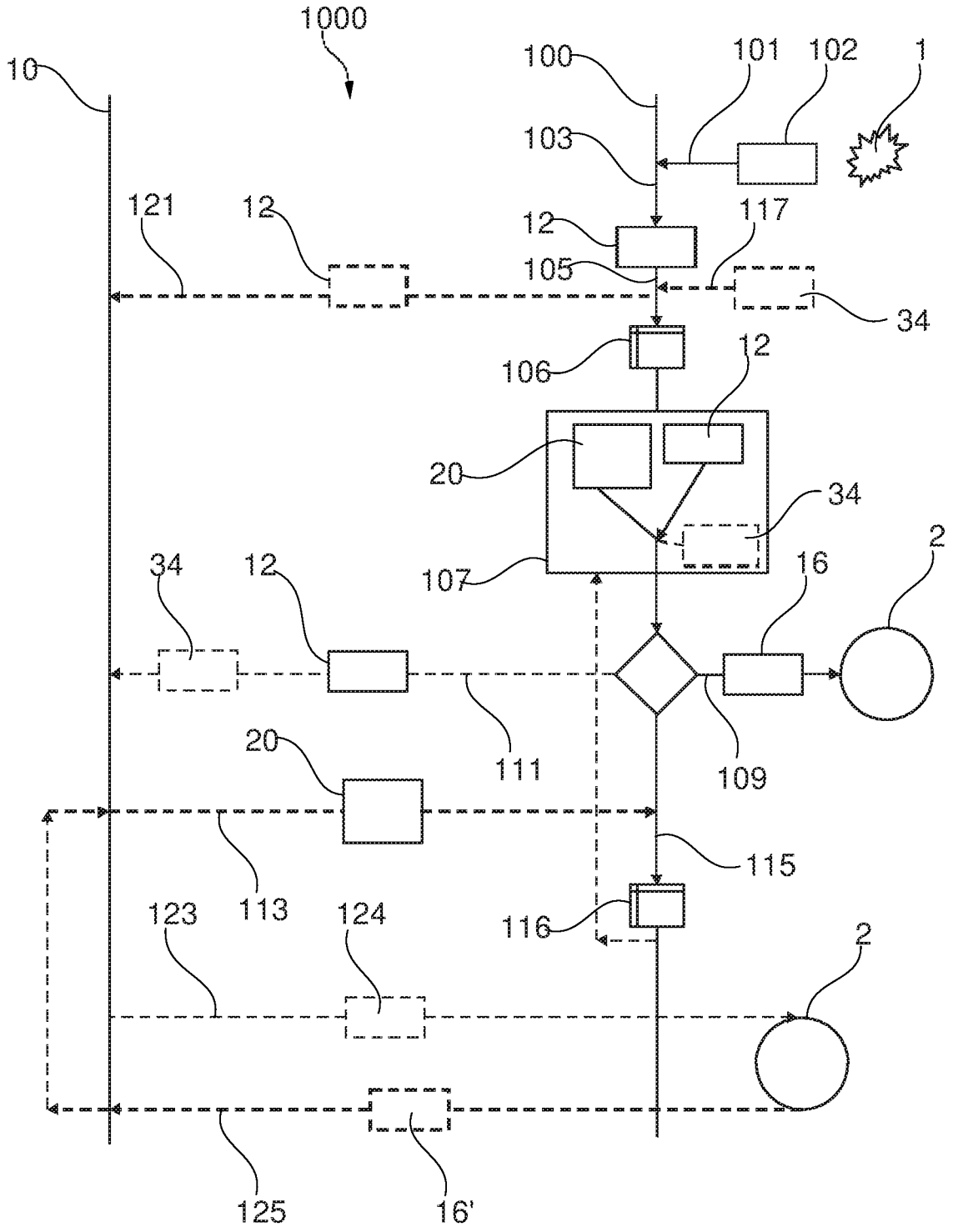
Figure 3:
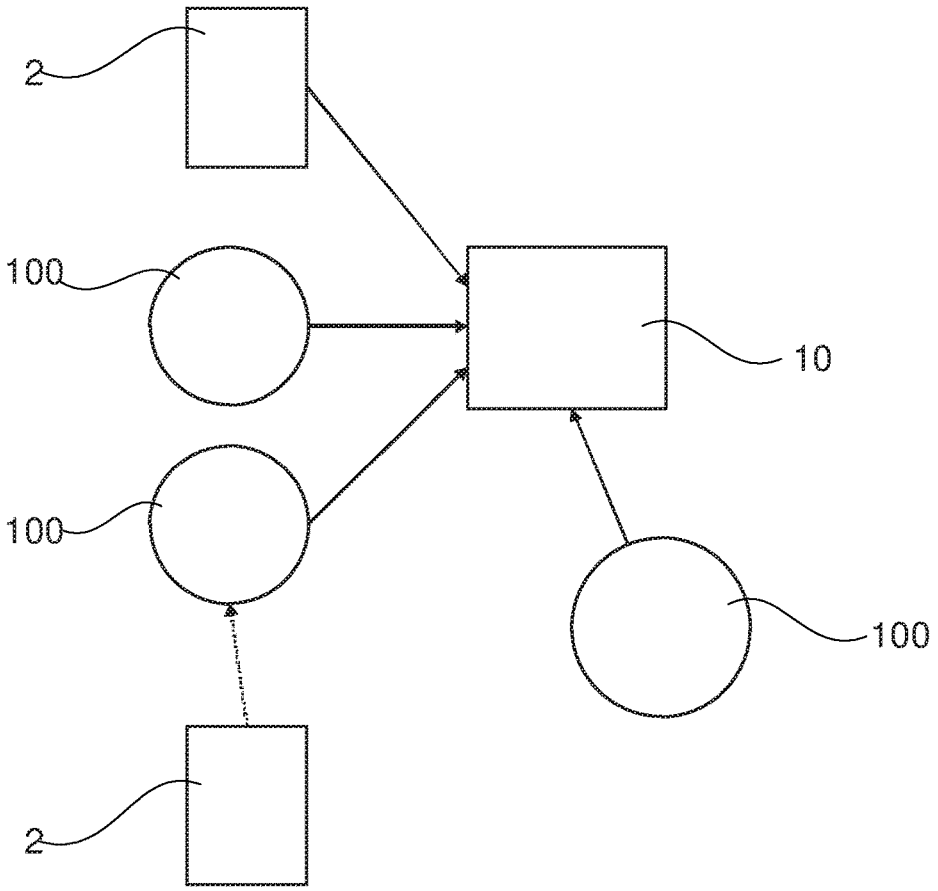
Figure 4:
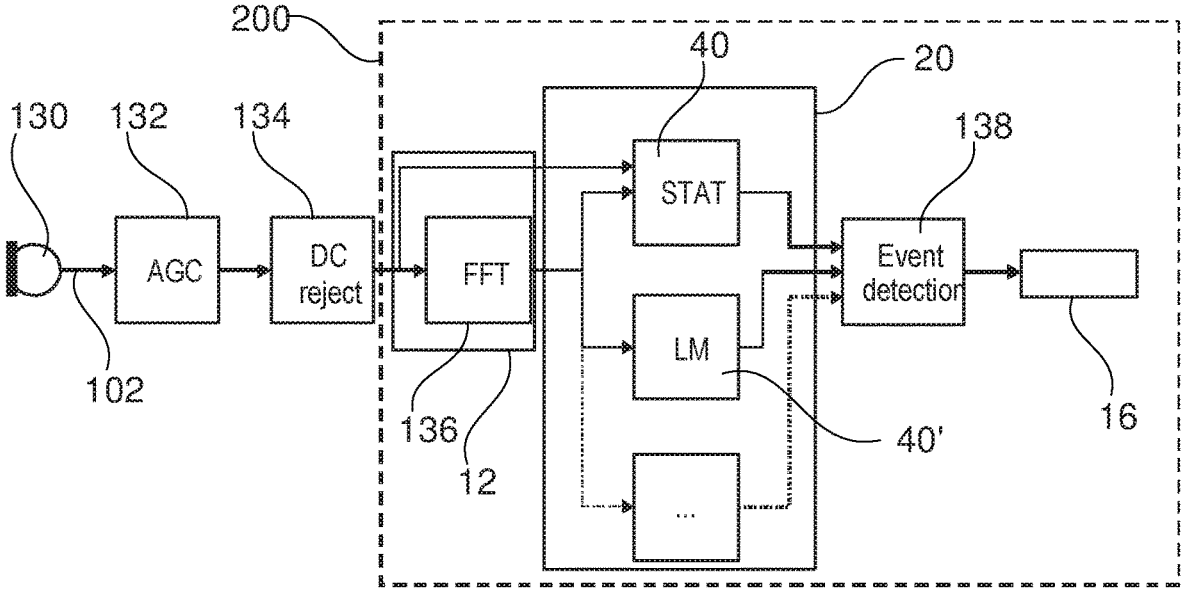
Figure 5:
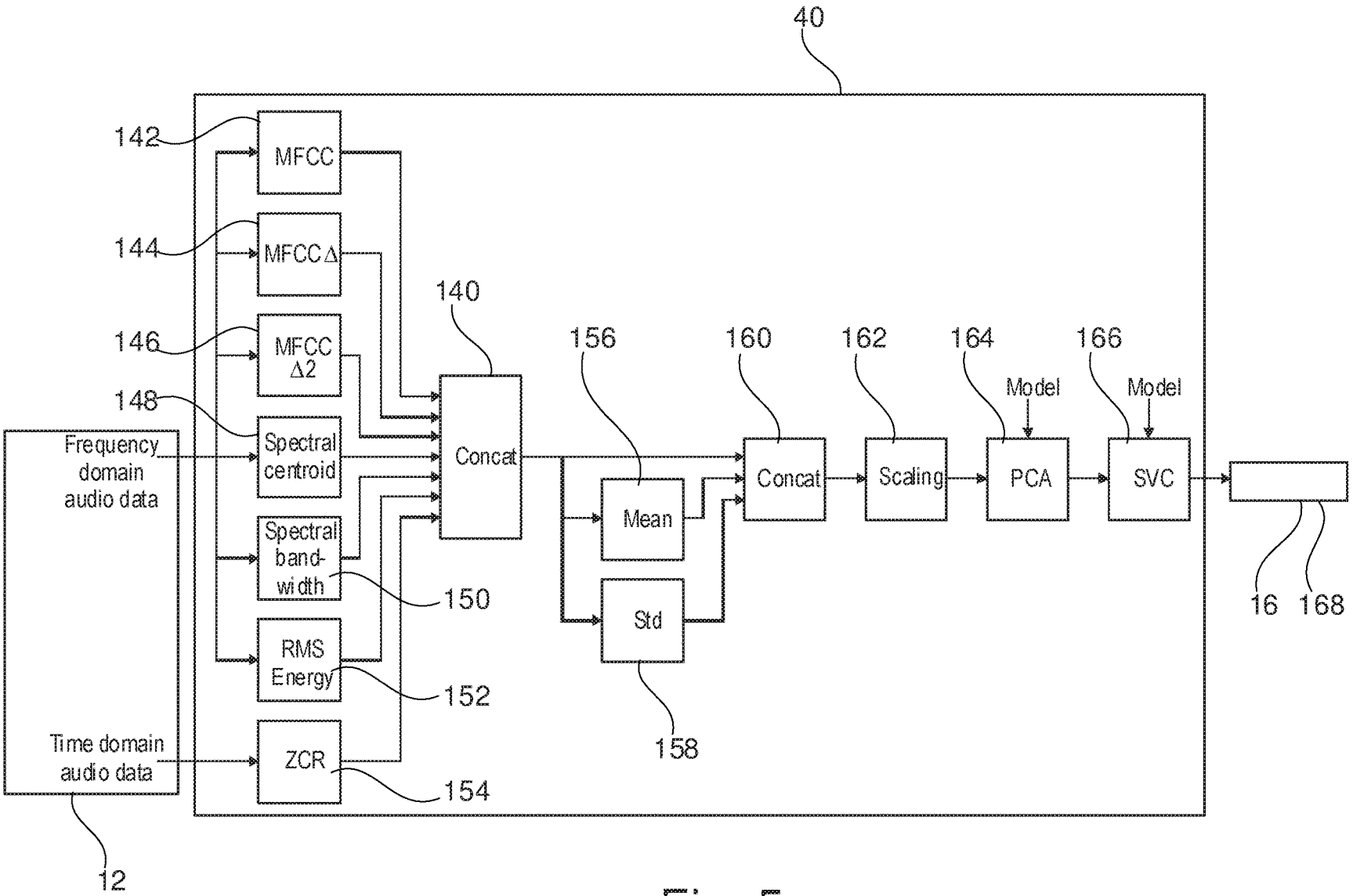
Figure 6:
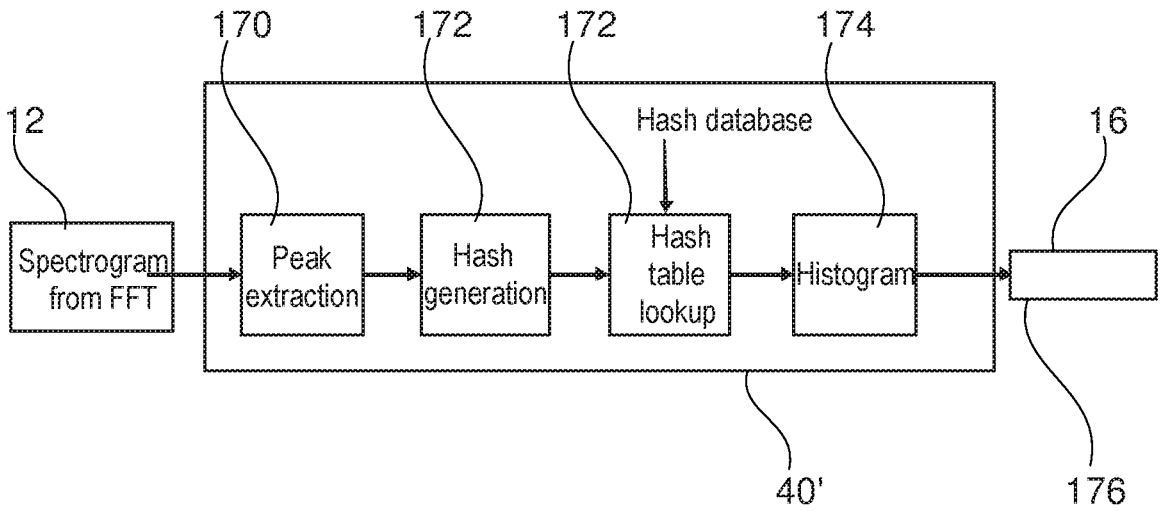
Figure 7:
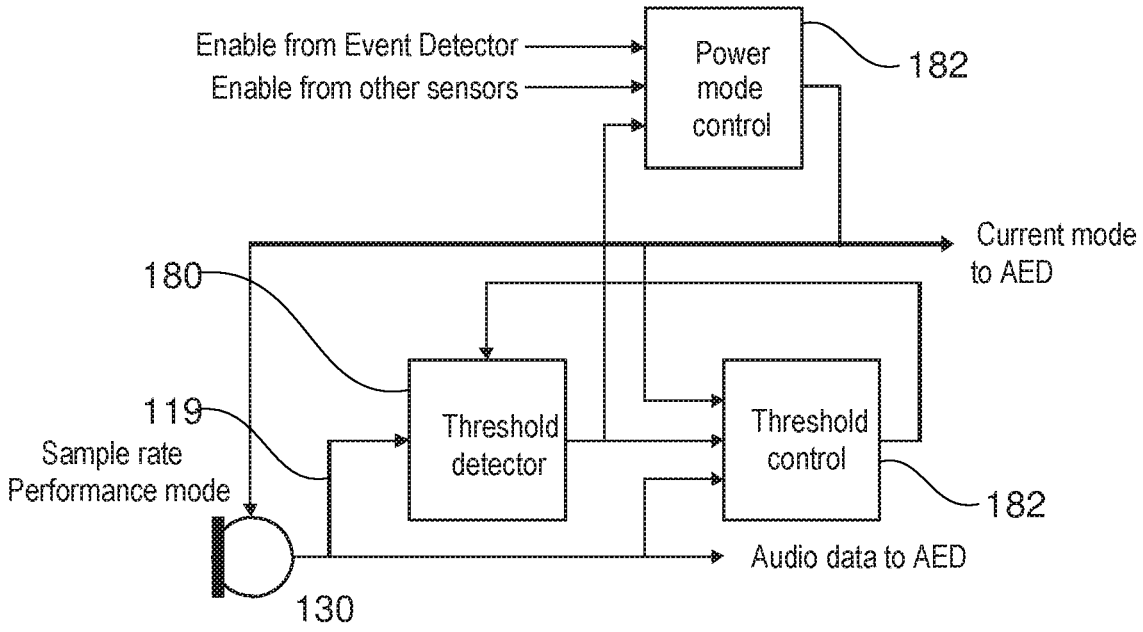
Figure 8:
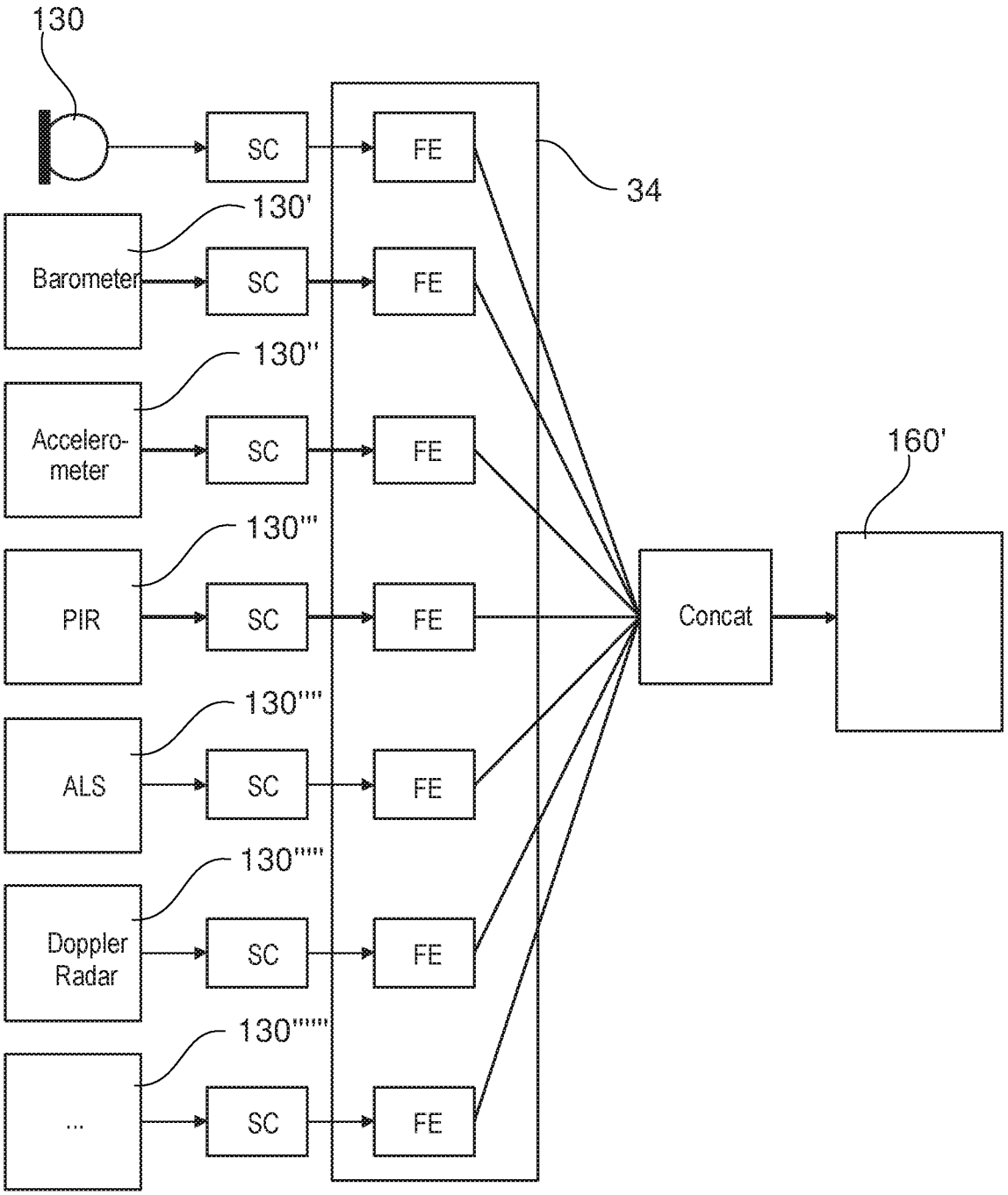
Figure 9:
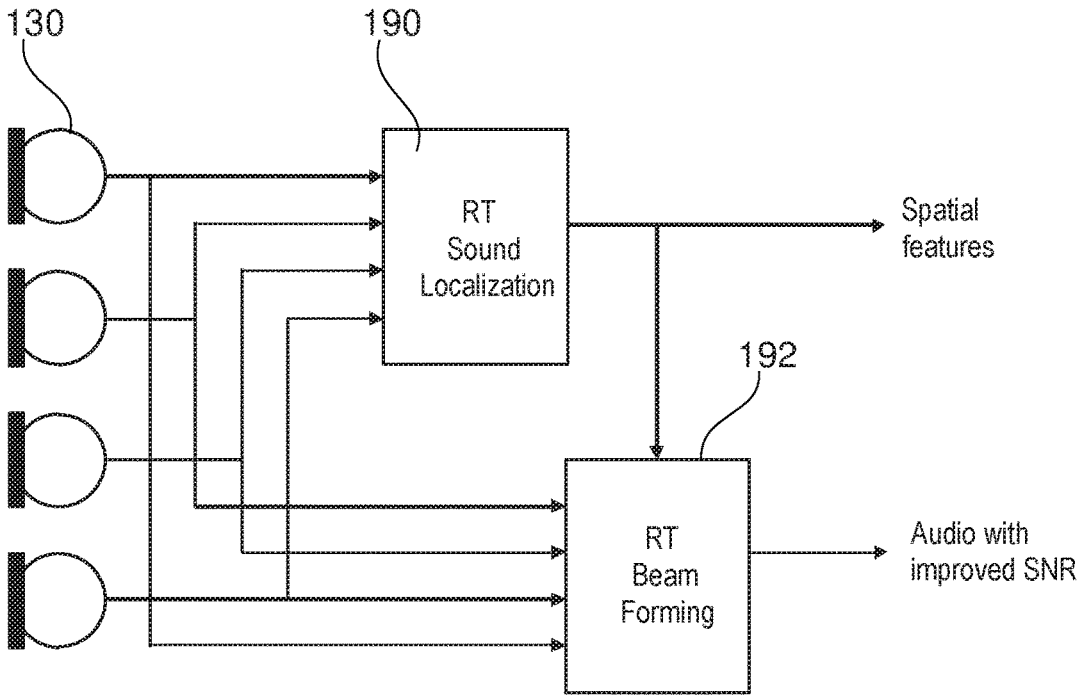
Figure 10:
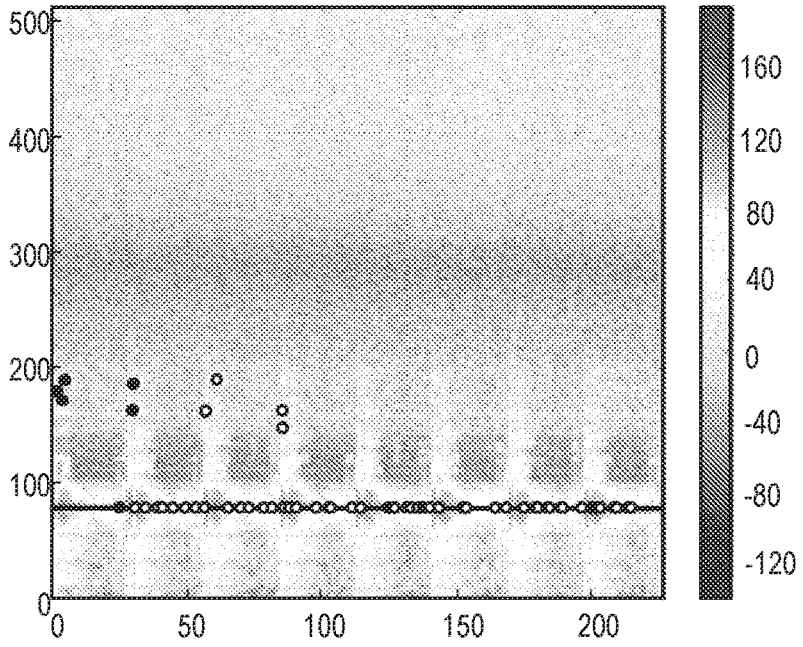
Figure 11:
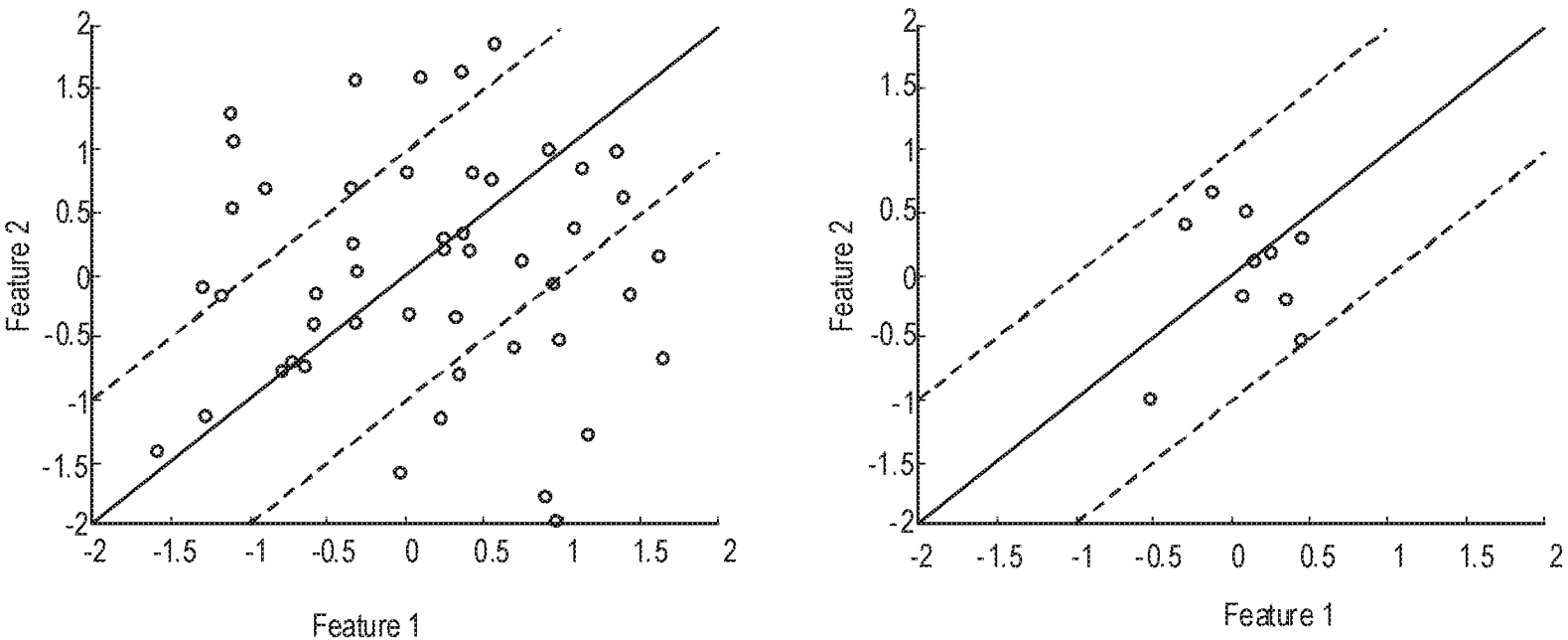
Figure 12:
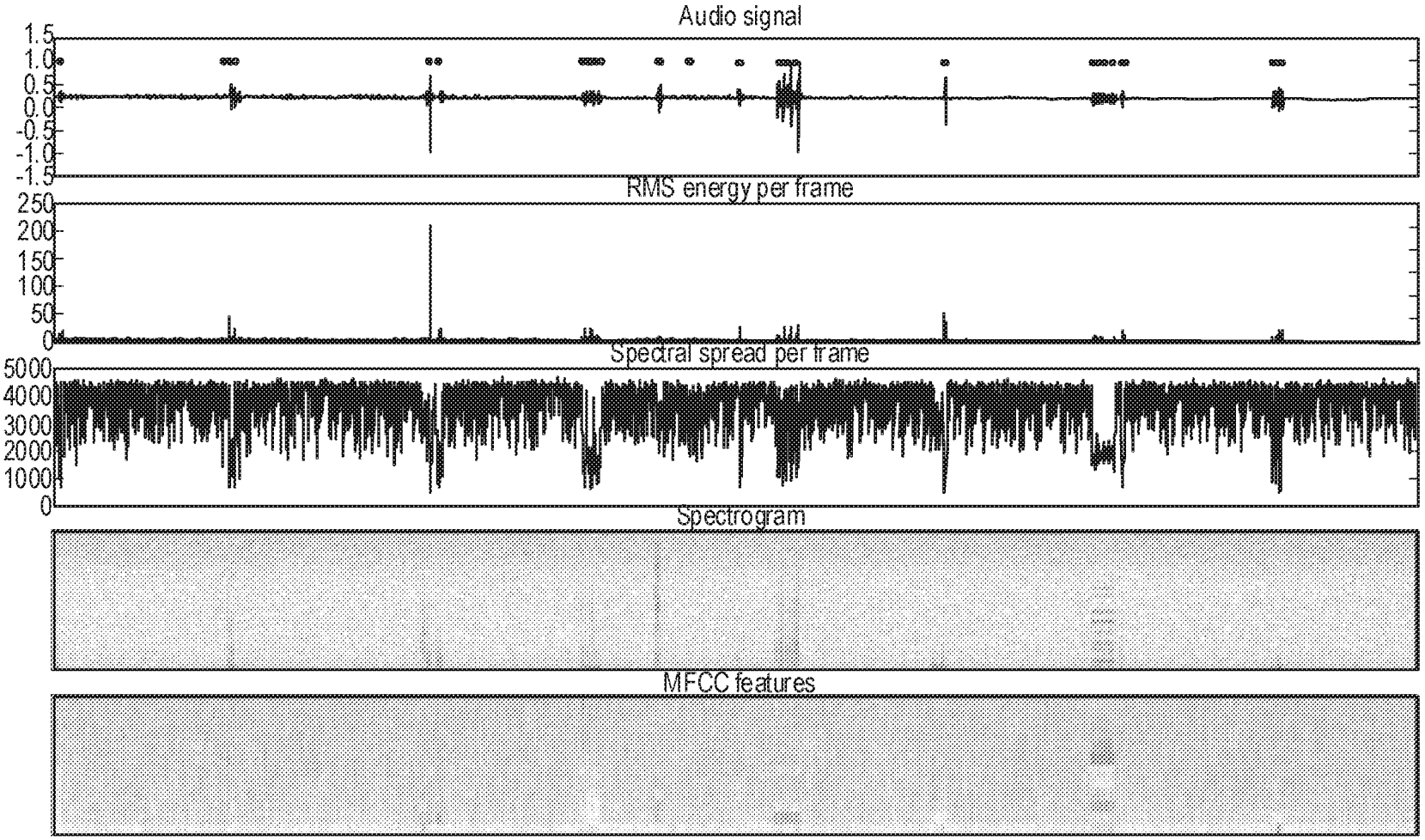

A more complete understanding of the abovementioned and other features and advantages of the present invention will be apparent from the following detailed description of preferred embodiments in conjunction with the appended drawings, wherein:

FIG. 1 shows the method according to the first aspect of the present invention performed by a processing node according to the third aspect of the present invention, FIG. 2 shows the method according to the second aspect of the present invention being performed by a communication device according to the fourth aspect of the present invention, FIG. 3 is a flowchart showing various ways in which audio data may be obtained for training the processing node, FIG. 4 is a flowchart of the pipeline for generating audio data and subjecting the audio data to one or more submodels to obtain an event designation on the communication device, FIG. 5 is a flowchart showing the pipeline of the STAT algorithm and model, FIG. 6 is a flowchart showing the pipeline of the LM algorithm and model, FIG. 7 is a flowchart showing the power management in the communication device, FIG. 8 is a flowchart showing how non-audio data from additional sensors may be used in the STAT algorithm and model, FIG. 9 is a flowchart showing how multiple audio data from multiple microphones can be used to localize the origin of a sound, and to use the location of the origin of the sound for beamforming and as further non-audio data to be used in the STAT algorithm and model, FIG. 10 shows the spectrogram of an alarm clock audio sample, FIG. 11 shows MFCC features of the raw audio samples, and FIG. 12 shows segmentation of audio data containing audio data for different events by measuring the spectral energy (RMS energy) of the frames, and the resulting spectrogram from which features such as MFCC features can be obtained and used for discrimination between noise and informative audio and for detecting an event.

In the below description of the figures the same reference numerals are used to designate the same features throughout the figures. Further, a 'added to a reference numeral indicates that the feature is a variant of the feature designated with the corresponding reference numeral not carrying the'-sign.

FIG. 1 shows the method according to the first aspect of the present invention performed by a processing node 10 according to the third aspect of the present invention.

The processing node 10 obtains, for example via a network such as the internet, as shown by arrow 11, audio data 12 from a communication device 100. This audio data is stored 13 in a storage or memory 14.

An event designation 16 is then obtained, for example via a network such as the internet, either from the communication device 100 as designated by the arrow 15, or vi another channel as indicated by the reference numeral 15'.

The event designation 16 is stored 17 in a storage or memory 18, which may be the same storage or memory as 14. Next a model 20 is determined 19 which associates the audio data 12 and the event designation 16, so that the model taking as input the audio data 12, yields the event designation 16. This model 20 is stored 21 in a storage or memory 22, which may be the same or different from storage or memory 14 and 18. The model 20 is then provided 23 to the communication device 100, thus providing the communication device 100 with a model 20 that the communication device can use to obtain an event designation based on audio data, as shown in FIG. 2.

Optionally the processing node 10 can also obtain 25 a unique communication device ID 26 from the communication device 100. This communication device ID 26 is also stored in storage or memory 14 and is also associated with the model 20 so that, where there is a plurality of communication devices 100, each communication device 100 may obtain the models 20 corresponding to audio data obtained from the communication device.

Further, where the processing node 10 obtains audio data 12 it may, in step 29, determine if there already exists a model 20 in the storage 22, in which case this model may be provided 23' to the communication device 100 without the requirement for determining a new model.

If no model 20 is found for the audio data 12 in the storage 22, then the processing node 10 may prompt 31 the communication device for obtaining 15 the event designation 16, where after the model may be determined as indicated by arrow 35.

Also, non-audio data 34 may be obtained 33 by the processing node. This non-audio data 34 is stored 13, 14 in the same way as the audio data 12, and also used when determining the model 20. Each model 20 may include a plurality of submodels 40, each associating the audio data 12, and optionally the non-audio data 34 with the event designation using a different algorithm or processing.

The processing node 10 and at least one communication device 100 may be combined in a system 1000.

FIG. 2 shows the method according to the second aspect of the present invention being performed by a communication device 100 according to the fourth aspect of the present invention.

Thus, when an event 1 occurs, an audio signal 102 is obtained 101 of the sound occurring with the event. The audio signal 102 is used to generate 103 audio data 12 associated with the sound. The audio data 12 is stored 105 in a storage or memory 106 in the communication device 100.

This audio data 12 is then subjected 107 to the model 20 stored on the communication device 100 and used to obtain the event designation 16 for the audio data.

The event designation is then provided 109 to a user 2 of the communication device 100, or example to the user's mobile phone or email address.

If however no event designation 16 is obtained, i.e. if none of the models 20 stored on the communication device 100 associates the audio data 12 with an event designation, then the communication device provides 111 the audio data 12 to the processing node 10. As described in FIG. 1 the processing node determines a model 20. This model 20 is then provided 113 to the communication device 100 and stored in a storage or memory 116, which may be the same as 106, where after the event designation 16 may be obtained from the now stored model 20.

Optionally further non-audio data 34 is also obtained 117 from sensors in the communication device. This non-audio data 34 is also subjected to the model 20 and used to obtain the event designation 16, and may also be provided 111 to the processing node 10 as described above.

As described in FIG. 7 further below, the energy in the sound signal 102 may also be measured 119 to only obtain the audio data 12 when the energy is above a threshold. When the threshold is surpassed audio data 12 is obtained and provided 121 to the processing node 10. Hereafter the communication device receives 123 a prompt 124 for an event designation 16' provided by the user 2, and once provided the communication device 100 provides this event designation 16' to the processing node 10, where after the processing node 10 may provide a model 20 to the communication device.

By storing a plurality of models 20 in the communication device 100 a plurality of event designations associated with a plurality of events may be obtained.

The communication device 100 may be placed in any suitable location in which it is desired to be able to detect events. The models 20 may be provided to the communication device 100 as needed. The models typically include both models associated with events specific to the user 2 of the communication device 100, but also include models for generic sounds such as gunshots, the sound of broken glass, an alarm, a dog barking, a doorbell, screams and coughing.

FIG. 3 is a flowchart showing various ways in which audio data may be obtained for training the processing node 10, The most common alternative is when the device 100 continuously and autonomously obtains audio data 12 from sounds, and, after finding that this audio data does not yield an event designation using the models stored on the communication device 100, providing 121 this audio data 12 to the processing node 10. The processing node 10 may then, periodically or immediately, prompt 31 the communication device 100 to provide an event designation 16. The prompt may contain an indication of the most likely event as determined using the models stored in the processing node.

Another alternative for collecting audio data 12 is to allow a user to use another device such as smartphone 2 running software similar to that running on the communication device 100 to record sounds and obtain audio data, and sending the audio data together with the event designation to the processing node 10. A smartphone 2 may also be used to cause a communication device 100 to capture record a sound signal and obtain and send audio data, together with an event designation, to the processing node 10.

In all cases communication between the communication devices, and the processing node 10, and between the smartphone 2 and the processing node 10 is preferably performed via a network, such as the internet or World Wide Web or a wireless data link. In summary, FIG. 3 illustrates: Smartphone 2 provides audio data on user request, communication device 100 autonomously provides audio data, communication device 100 provides audio data on user request and other communication device 100 provides audio data.

FIG. 4 is a flowchart of the pipeline for generating audio data and subjecting the audio data to one or more submodels to obtain an event designation on the communication device 100, Sound in the location in which the communication device 100 is placed is continuously obtained by a microphone 130 and converted to an electric sound signal 102. This signal is then operated on by a step of Automatic Gain Control using an automatic gain control module 132 to obtain a volume normalization of the sound signal. This sound signal is then further treated by high pass filtering in a DC reject module 134 to remove any DC voltage offset of the sound signal. The thus normalized and filtered signal is then used to obtain audio data 12 by being subjected to Fast Fourier Transform in a FFT module 136 in which the sound signal is transformed into frequency domain audio data. This transformation is done by, for each incoming audio sample 2 s in length creating a spectrogram of the audio signal by taking the Short Time Fourier Transform (STFT) of the signal. Thus the FFT of a short time frame is computed and that frame is sliding by for example 10 ms (50% overlap) until the end of the audio signal is reached.

Alternatively the SFTF may be computed continuously, i.e. without dividing the audio sample into 2 s samples.

The audio data 12 now comprises frequency domain and time domain data and will now be subjected to the models stored on the communication device. In this case the model 20 includes several submodels, also called analysis pipelines, of which the STAT submodel 40 and the LM submodel 40' are two.

The result of the submodels leads to event designations, which after a selection based on a computed probability or certainty of the correct event designation being obtained, as evaluated in a selection module 138, leads to obtaining of an event designation Specifically each submodel may provide an estimated or actual value of the accuracy by which the event designation is obtained, i.e. the accuracy with which a certain event is determined, or alternatively the probability that the correct event has been determined. The computed probability or certainty may also be used to determine whether the audio data 12 should be provided to the processing node 10.

The communication device 100 may comprise a processor 200 for performing the method according to the first aspect of the present invention.

FIG. 5 is a flowchart showing the pipeline of the STAT algorithm and model 40.

This algorithm takes as input audio data 12 comprising frequency domain audio data and time domain audio data and constructs a feature vector 140, by concatenation, consisting of, for example, MFCC (Mel-frequency cepstrum coefficients) 142, their first and second order derivatives 144, 146, the spectral centroid 148, the spectral bandwidth 150, RMS energy 152 and time-domain zero crossing rate 154. The mean and standard deviation 156 and 158 of these features over a window of several feature vectors are also calculated and appended to the form a feature vector 160 by concatenation. Each feature vector 160 is then scaled 162 and transformed using PCA (Principal Component Analysis) 164, and then fed into a SVM (Support Vector Machine) 166 for classification. Parameters for PCA and for SVM are provided in the submodel 40.

The SVM 166 will output an event designation 16 as a class identifier and a probability 168 for each processed feature vector, thus indicating which event designation is associated with the audio data, and the probability.

In FIG. 5 the submodel 40 is shown to encompass the majority of the processing of the audio data 12 because in this case the requirements for the feature vector 160 to be supplied to the principal component analysis 164 are considered part of the model.

Alternatively the submodel 40 may be defined to only encompass the parameters needed for the PCA 164 and the SVM 166, in which case the audio data is to be understood as encompassing the feature vector 160 after scaling 162, the preceding steps being part of how the audio data is obtained/generated.

FIG. 6 is a flowchart showing the pipeline of the LM algorithm and model 40'.

This model takes as input audio data 12 in the frequency domain and extracts prominent peaks in the continuous spectrogram data in a peak extraction module 170 and filters the peaks so that a suitable peak density is maintained in time and frequency space. These peaks are then paired to create "landmarks", essentially a 3-tuple (frequency 1 (f1), time of frequency 2 minus time of frequency 1 (t2−t1), frequency 2 minus frequency 1 (f2−f1)). These 3-tuples are converted to hashes in a hash module 172 and used to search a hash table 174. The hash table is based on a hash database.

If found, the hash table returns a timestamp where this landmark was extracted from the (training) audio data supplied to the processing node to determine the model.

The delta between t1 (the timestamp where the landmark was extracted from the audio data to be analyzed) and the returned reference timestamp is fed into a histogram 174. If a sufficiently high peak is developed in the histogram over time, the algorithm can establish that that the trained sound has occurred in the analyzed data (i.e. multiple landmarks has been found, in the correct order) and the event designation 16 is obtained. The number of hash matches in the correct histogram bin(s) per time unit can be used as a measure of accuracy 176. In FIG. 5 the LM submodel is shown to encompass the majority of the processing of the audio data 12 because in this case the requirements for the Hash table lookup 172 is considered part of the model.

Alternatively the LM submodel 40' may be defined to only encompass the Hash database, in which case the audio data is to be understood as encompassing generated hashes after step 172, the preceding steps being part of how the audio data is obtained/generated.

FIG. 7 is a flowchart showing the power management in the communication device 100.

In the communication device 100, which is preferably battery powered, power conservation is of uttermost importance. Thus, the audio processing for obtaining audio data and subjecting the audio data to the model should only be run when a sound of sufficient energy is present, or speculatively when the communication device have detected an event using any other sensor.

The communication device 100 may therefore contain a threshold detector 180, a power mode control module 182, and a threshold control module 184. The threshold detector 180 is configured to continuously measure 119 the energy in the audio signal from the microphone 130 and inform the power mode control module 182 if it crosses a certain, programmable threshold. The power mode control module 182 may then wake up the processor obtaining audio data and subjecting the audio data to the model. The power mode control module 182 may further control the sample rate as well as the performance mode (low power, low performance vs high power, high performance) of the microphone 130.

The power mode control module 182 may further take as input events detected by sensors other than the microphone 130, such as for example a pressure transient using a barometer, a shock using an accelerometer, movement using a passive infrared sensor (PIR) and doppler radar, etc.), and/or other data such as time of day etc.

The power mode control module 182 further sets the Threshold control module 184 which sets the threshold of the threshold detector 180 based on for example a mean energy level or other data such as time of day.

In each any case audio data obtained due to the threshold being surpassed is provided to the processor for starting automatic event detection (AED) i.e. the subjecting of audio data to the models and the obtaining of event designations.

FIG. 8 is a flowchart showing how non-audio data from additional sensors may be used in the STAT algorithm and model, Thus, in addition to audio data from the microphone 130, data may be provided by a barometer 130', an accelerometer 130'', a passive infrared sensor (PIR) 130''', an ambient light sensor (ALS) 130'''', a Doppler radar 130''''', or any other sensor represented by 130''''''.

In each case the non-audio data is subjected to sensor-specific signal conditioning (SC), frame-rate conversion (to make sure the feature vector rate matches up from different sensors) and feature extraction (FE) of suitable features before being joined to the feature vector 160 by concatenation thus forming an extended feature vector 160'. The extended feature vector 160' may then be treated as the feature vector 160 shown in FIG. 5 using principal component analysis 164 and a support vector machine 466 in order to obtain an event designation.

Alternatively non-audio data 34 from the additional sensors may be provided to the processing node 10 and evaluated therein to increase the accuracy of the detection of the event. This may be advantageous where the communication device 100 lacks the computational facilities or is otherwise constrained, for example by limited power, from operating with the extended feature vector 56'.

FIG. 9 is a flowchart showing how multiple audio data from multiple microphones can be used to localize the origin of a sound, and to use the location of the origin of the sound for beamforming and as further non-audio data to be used in the STAT algorithm and model 40

In the communications device 100 shown in FIG. 9 multiple audio data streams from an array of multiple microphones 130, can be used to localize the origin of a sound using XCORR, GCC-PHAT, BMPH or similar algorithms, and to use the location of the origin of the sound for beamforming and as further non-audio data to be added to an extended feature vector 160' in the STAT pipeline/algorithm.

Thus a sound localization module 190 may extract spatial features for addition to an extended feature vector 160'. Further, a beam forming module 192 may be used to, based on the spatial features provided by the sound localization module 190, combine and process the audio signals from the microphones 130, in order to provide an audio signal with improved SnR. The spatial features can be used to further improve detection performance for user-specific events or provide additional insights (e.g. detect which door was opened, tracking moving sounds, etc.).

To minimize the current consumption, all microphones in the array except one can be powered down while in idle mode.

Example 1—Prototype Implementation of LM Pipeline

A prototype system was set up to include a prototype device configured to record audio samples 2 s in length of an alarm clock ringing. These audio samples were temporarily stored in a temporary memory in the device for processing.

Processing is first performed taking a Short Time Fourier Transform (STFT) (corresponding to the FFT module 18 in FIG. 4), creating a spectrogram. In the STFT process a FFT of short time frame is computed and that frame is sliding by 10 ms (50% overlap) until the end of the audio signal has been reached. In this case 20 ms frames were used resulting in a FFT size of 1024, i.e. a resolution of the frequency content of the signal in 1024 different frequency bins.

FIG. 10 shows the spectrogram of the alarm clock audio sample. As seen in the figure, the spectral peaks are distributed along the time domain in order to cover as many 'interesting' parts of the audio sample as possible. The landmarks, circles, are pairs between 2 spectral peaks and act as an identification for the audio sample at a given time.

In the prototype implementation 6 pairs were used for each landmark, each landmark having the following format:

landmark: [time1, frequency1, dt, frequency2]

Accordingly a landmark is a coordinate in a two-dimensional space as defined from the spectrogram of the audio sample. The landmarks were then converted into hashes and then stored into a local database/memory block.

Example 2—Prototype Implementation of a STAT-Pipeline Submodel

In the prototype system described above a STAT pipeline was also implemented as follows:

Input audio is broken into segments depending on the energy of the signal whereby audio segments that exceed an adaptive energy threshold move to the next stage of the processing chain where perceptual, spectral and temporal features are extracted. The audio segmentation algorithm begins by computing the rms energy of 4 consecutive audio frames. For the next incoming frame an average rms energy from the current and previous 4 frames will be computed and if it exceeds a certain threshold an onset is created for the current frame. On the other hand, offsets are generated when the average rms energy drops below the predefined threshold.

Each audio segment that passes the threshold should be processed. This involves dividing each audio segment into 20 ms frames with an overlap of 50%. This further includes performing a Short Time Fourier Transform (STFT) as described above to obtain frequency domain data in addition to the time domain data.

For each audio frame the following features are computed:

- 13 Mel-cepstrum coefficients (MFCCs) not including MFCC0
- Deltas of MFCCs
- delta deltas of MFCCs
- Spectral centroid
- Spectral spread
- Zero-crossing rate
- Root mean square energy accumulating a total of 43 features and generating one such feature matrix per audio segment of size M×N, where M is the number of frames in the audio segment and N is the number of features (43). The feature matrix is then converted into a single feature vector that contains the statistics (mean, std) of each feature in the feature matrix resulting in a vector of size 1×86, compare to FIG. 5

The averaging of the feature matrix is done using a context window of 0.5 s with an overlap of 0.1 s. Given that each row in the feature matrix represents a datapoint to be classified, reducing/averaging the datapoints before classification filters the observations from noise. See FIG. 10 for a demonstration in which the graph to the right shows the result after noise filtering.

The resulting vector is fed to a Support Vector Machine (SVM) to determine the identity to the audio segment (classification) see FIG. 11 showing MFCC features of the raw audio samples in which the solid line designates the decision surface of the classifier and the dashed lines designate a softer decisions surface.

The classifier used for the event detection is a Support Vector Machine (SVM). The classifier is trained using a one-against-one strategy under which K SVMs are trained in a binary classification problem. K equals to $C*(C-1)/2$ number of classifiers, where C is the number of audio classes in the audio detection problem. The training of the SVM is done with audio segmentation, feature extraction and SVM classification done using the same approach as described above and as shown in FIG. 12.

The topmost graph in FIG. 12 shows the audio sample containing audio data for different events together with designated segments defined by the markers marking the onset and offset of the segments. As mentioned above the segments are defined by measuring the spectral energy (RMS energy) of the frames, see second graph from the top.

As can be seen in the third frame there is a spectral spread per frame corresponding to the RMS energy.

The result is a spectrogram (second graph from the bottom) from which features such as MFCC features can be obtained and used for discrimination between noise and informative audio and for obtaining an event designation.

The invention claimed is:

1. A method performed by a processing node, comprising the steps of:

i. (a) obtaining a first plurality of audio data from a plurality of communication devices, and (b) storing the first plurality of audio data in the processing node, wherein each of the plurality of communication devices is associated with a unique communication device ID;

ii. (a) obtaining a first plurality of event designations associated with the first plurality of audio data, and (b) storing the first plurality of event designations in the processing node;

iii. (a) determining a first plurality of models, each of the first plurality of models associating one of the first plurality of audio data with one of the first plurality of event designations, and (b) storing the first plurality of models;

iv. providing the first plurality of models to the plurality of communication devices;

v. obtaining the unique communication device ID from each of the plurality of communication devices; and vi. associating the unique communication device ID from each of the plurality of communication devices with audio data obtained from that communication device; wherein:

step (iii) comprises associating each of the first plurality of models with the unique communication device ID of the communication device from which the audio data used to determine the model was obtained; and step (iv) comprises providing the first plurality of models to the plurality of communication devices so that each of the plurality of communication devices obtains at least the models of the first plurality of models that are associated with the unique communication device ID associated with that communication device.

2. The method according to claim 1, further comprising the steps of:

vii. obtaining, from a first one of the plurality of communication devices, first audio data not associated with any model provided to that communication device;

viii. searching, among the first plurality of audio data obtained from the plurality of communication devices in step (i), for second audio data that are similar to the first audio data, and that were obtained by a second one of the plurality of communication devices;

ix. in response to the second audio data being found, providing, to the first one of the plurality of communication devices, the model associated with the second audio data;

x. in response to the second audio data not being found, prompting the first one of the plurality of communication devices to provide the processing node with a first event designation associated with the first audio data;

xi. determining a first model that associates the first audio data with the first event designation, and storing the first model; and xii. providing the first model to the first one of the plurality of communication devices.

3. The method according to claim 1, further comprising the step of:

vii. obtaining, from each of the plurality of communication devices, a first plurality of non-audio data associated with the first plurality of audio data, and storing the first plurality of non-audio data in the processing node;

wherein step (iii) comprises determining a model that associates the first plurality of audio data and the first plurality of non-audio data with each of the first plurality of event designations.

4. The method according to claim 1, wherein each of the first plurality of models determined in step (iii) comprises a plurality of sub-models, each of the plurality of sub-models being determined using a different algorithm associating the first plurality of audio data with the first plurality of event designations.

5. The method according to claim 3, wherein each of the first plurality of models determined in step (iii) comprises a plurality of sub-models, each of the plurality of sub-models being determined using a different algorithm associating the first plurality of audio data and the first plurality of non-audio data with the first plurality of event designations.

6. The method according to claim 1, wherein each of the plurality of models is based at least partly on principal component analysis of characteristics of frequency domain transformed audio data.

7. The method according to claim 6, wherein each of the plurality of models is further based at least partially on at least one of principal component analysis of non-audio data, histogram data of frequency domain transformed audio data, and histogram data of frequency domain transformed non-audio data.

8. The method according to claim 1, further comprising the steps of:

vii. obtaining, from at least one of the plurality of communication devices, a second plurality of audio data, and storing the second plurality of audio data in the processing node;

viii. searching, in the processing node, for a third plurality of audio data that are similar to the second plurality of audio data; and ix. in response to the third plurality of audio data being found, determining a model associated with the third plurality of audio data by associating an event designation associated with the third plurality of audio data with both the second plurality of audio data and the third plurality of audio data.

9. The method according to claim 8, further comprising the steps of:

x. obtaining, from at least one communication device, a first plurality of non-audio data, and storing the first plurality of non-audio data in the processing node;

xi. searching, in the processing node, for a second plurality of non-audio data that is similar to the first plurality of non-audio data; and xii. in response to the second plurality of non-audio data being found, determining a model associated with the second plurality of non-audio data, by associating an event designation associated with the second plurality of non-audio data with both (a) the second plurality of audio data and the first plurality of non-audio data; and (b) the third plurality of audio data and the second plurality of non-audio data.

10. A method performed by a communication device on which are stored a first model associating first audio data and first non-audio data with a first event designation, the method comprising the steps of:

i. (a) recording an audio signal of a sound, (b) generating first audio data associated with the sound based on the audio signal, and (c) storing the first audio data;

ii. (a) obtaining first non-audio data associated with the first audio data, and (b) storing the first non-audio data;

iii. subjecting the first audio data and the first non-audio data to the first model stored on the communication device to obtain the first event designation; and iv. in response to the first event designation not being obtained, performing the further steps of:

a. providing the first audio data and the first non-audio data to a processing node;

b. obtaining, from the processing node, a second model associating second audio data and second non-audio data with a second event designation;

c. storing the second model on the communication device;

d. subjecting the first audio data and the first non-audio data to the second model stored on the communication device to obtain the second event designation; and e. providing the second event designation to a user of the communication device.

11. The method according to claim 10, wherein:

step (i) comprises the steps of:

(i)(a) continuously measuring energy in the audio signal;

(i)(b) generating the first audio data upon the energy in the audio signal exceeding a threshold; and (i)(c) providing the first audio data thus generated to the processing node; and wherein the method further comprises the steps of:

v. receiving, from the processing node, a prompt for an event designation associated with the first audio data and the first non-audio data provided to the processing node;

vi. obtaining a further event designation from a user of the communication device;

vii. providing the further event designation obtained from the user to the processing node; and viii. obtaining, from the processing node, a further model associating the first audio data with the further event designation obtained from the user.

12. The method according to claim 10, wherein:

each of the first and second models stored on the communication device comprises a plurality of sub-models, each sub-model being determined using a different algorithm associating the first audio data with the first event designation; and wherein:

step (ii) comprises the steps of:

(ii)(a) obtaining a plurality of event designations from the plurality of sub-models;

(ii)(b) determining the probability that each of the plurality of event designations corresponds to an event associated with the first audio data;

(ii)(c) selecting, among the plurality of event designations, one event designation having the highest probability determined in step (ii)(b); and (ii)(d) providing the one event designation to the user of the communication device.

13. The method according to claim 12, wherein each sub-model is further determined using a different algorithm associating the first and second audio data and the first and second non-audio data with the first and second event designations, respectively.

14. A communication device, comprising:

a memory in which is stored a first model associating first audio data and first non-audio data with a first event designation, and machine executable code including instructions; and a processor operatively coupled to the memory and configured to execute the instructions in the machine executable code to:

(i) (a) record an audio signal of a sound, (b) generate first audio data associated with the sound based on the audio signal, and (c) store the first audio data;

(ii) (a) obtain first non-audio data associated with the first audio data, and (b) store the first non-audio data;

(iii) subject the first audio data and the first non-audio data to the first model stored in the memory to obtain the first event designation; and (iv) to perform, in response to the first event designation not being obtained, the further steps of:

a. providing the first audio data and the first non-audio data to a processing node;

b. obtaining, from the processing node, a second model associating second audio data and second non-audio data with a second event designation;

c. storing the second model in the memory;

e. subjecting the first audio data and the first non-audio data to the second model stored in the memory to obtain the second event designation; and f. providing the second event designation to a user of the communication device.

* * * * *